United States Patent [19]

Kawasaki et al.

[11] Patent Number: 4,968,353

[45] Date of Patent: Nov. 6, 1990

[54] METHOD FOR REFINING SUGAR LIQUOR

[75] Inventors: Kohji Kawasaki; Fumio Maekawa, both of Okazaki, Japan

[73] Assignee: C. Itoh Sugar Co., Ltd., Aichi, Japan

[21] Appl. No.: 381,115

[22] Filed: Jul. 14, 1989

[30] Foreign Application Priority Data

Jul. 15, 1988 [JP] Japan ..... 63-176265
Jul. 15, 1988 [JP] Japan ..... 63-176266

[51] Int. Cl.[5] ..... C13J 1/06; C13D 3/12; C13D 3/14

[52] U.S. Cl. ..... 127/46.2; 127/46.3; 127/55; 127/58; 426/271; 210/660; 210/670; 502/407

[58] Field of Search ..... 127/46.2, 46.3, 55; 426/271; 210/660, 670; 502/407

[56] References Cited

U.S. PATENT DOCUMENTS

| | | | |
|---|---|---|---|
| 2,890,138 | 6/1959 | Smith et al. | 127/46.2 |
| 3,992,327 | 11/1976 | Sadler, III et al. | 502/407 |
| 4,409,033 | 10/1983 | LeRoy | 127/46.2 |
| 4,412,866 | 11/1983 | Schoenrock et al. | 127/46.2 |
| 4,587,953 | 5/1986 | Rosene | 127/55 |

*Primary Examiner*—Chung K. Pak

*Attorney, Agent, or Firm*—Philip M. Shaw, Jr.

[57] ABSTRACT

A method for refining a sugar liquor by cristobalite and an ion exchange resin, and a method for refining the sugar liquor by a novel ion exchange resin refining system, are disclosed. Cristobalite exhibits specific adsorbant properties for various colloidal or suspended substances, while the ion exchange resin exhibits superior decoloring and desalting properties with respect to colorants and salts. By combining refining by cristobalite and refining by the ion exchange resin, there is provided a sugar refining system whereby even non-washed sugar liquor may be refined. The ion exchange resin refining system of the present invention includes three series of adsorption towers. Each series basically consists of a strongly basic anion exchange resin and a weakly acidic cation exchange resin, and the towers of each of these three series are shifted in a sequence of the pre-stage adsorption tower, the adsorption tower for regeneration, the post-stage adsorption tower and again back to the pre-stage adsorption tower, so that the ability of the strongly basic anion exchange resin may be displayed to the utmost, while the colorant adsorbant properties and the deanionation properties may be exhibited effectively.

11 Claims, 3 Drawing Sheets

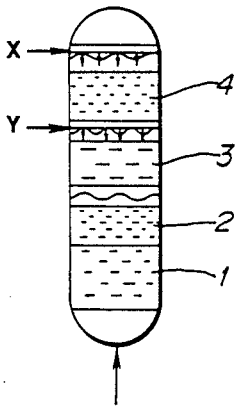
FIG. 1
FIG. 2A
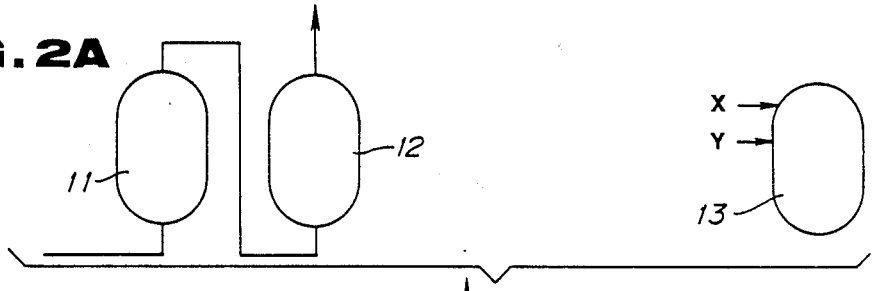
FIG. 2B
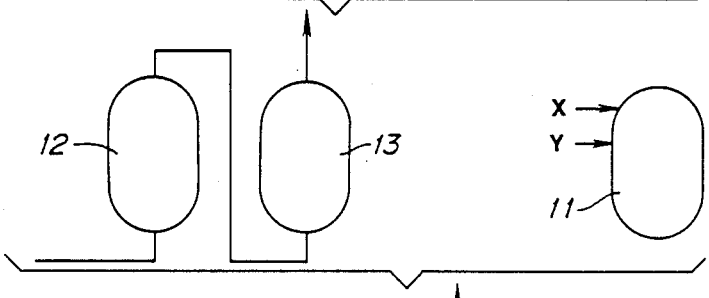
FIG. 2C
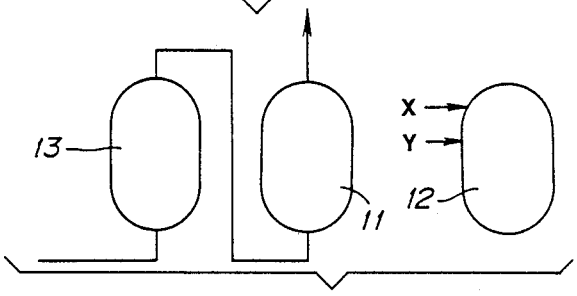

METHOD FOR REFINING SUGAR LIQUOR

BACKGROUND OF THE INVENTION

1. Field of the Invention

This invention relates to a method for refining a sugar liquor containing impurities including colloidal or suspended materials, colorants, ashes, microorganisms and odor emitting substances. It also relates to a method for refining a sugar liquor through decoloration and desalting and, more particularly, to a method for refining sugar liquor using ion exchange resins.

2. Prior Art

The major portion of the impurities contained in the raw sugar is included in a molasses film affixed to the crystal surface and is mainly composed of coloring matter, ashes, invert sugar, fatty acid, amino acids, colloidal matter and microorganisms. The conventional practice has been to remove these impurities to some extent by a washing operation to separate the raw sugar into a so-called washed sugar and washed molasses before proceeding to the subsequent refining process.

Meanwhile, about 10% of sucrose based on raw sugar is disolved in the washed molasses, it being extremely difficult to recover sucrose from these washed molasses. This sucrose recovered after crystallization from the washed molasses is low in commercial value and must be subjected to redissolution thus resulting in lowered refining yield. Moreover, the complicated process represents a major factor in lowering the process capacity.

Attempts have been made in this nation to dissolve and refine raw sugar without an intermediate sugar washing process, as exemplified in the Japanese Patent Publication Nos. 24494/1965 and 19595/1968. However, none of them have won commercial success.

The reason for such failure is presumably ascribable to the fact that no pre-treating refining method of reducing the load of the ion exchange resin process has been evolved. Therefore, when the refining of the unwashed sugar liquor is tentatively performed through improvement of the ion exchange resin arrangement or the manner of passing or regenerating the sugar liquor, the capacity of the ion exchange resin is drastically lowered with increase in the number of cycles, resulting in failure in producing desired decoloration and desalting effects or ultimate economic effects.

A large amount of suspended materials are contained in sugar liquor, especially unwashed sugar liquor, so that a pretreating refining method for effectively removing these suspended materials is strongly desired. Should these suspended materials be removed effectively, the load of the ion exchange resin process may be lowered, so that one may expect more effective decoloration and desalting.

It is however extremely difficult to remove the suspended materials contained in the unwashed high concentration sugar liquor, washed molasses or a variety of molasses by a filtration or a centrifugation method. Although these may be removed by special filtration operations, such as ultra precision filtration, self-extrusion film or ultrafiltration film methods, the operating costs are unbearably increased.

On the other hand, application of ion exchange resins to the sugar refining industry has been made extensively, such that it is not too much to say that this system is adopted by almost all sugar makers in some form or other.

However, this system is mainly intended for decoloration by a unitary tower packed with a chlorine type strong basic anion exchange resin, and is no more than a technique of partially refining the washed sugar liquor. Although the method for refining the unwashed sugar liquor is an ultimate target of sugar refining, the prior art system lacks in the capacity of removing impurities, mainly the decoloration and desalting in the course of the ion exchange resin process, such that the conventional sugar refining process cannot be superseded by the ion exchange resin system not only in quality but economically.

The present inventors have been engrossed in developing a desalting and refining technique through the use of ion exchange resins. It has now emerged from our experiences that evolution of some technical measures for combatting the lowering of the capacity of the strongly basic anion exchange resins is utmost importance.

In this connection, there are proposed various techniques centered about resin regeneration and restoration methods, as exemplified by the Japanese Patent Publications Nos. 11385/1980, 46218/1980 and 24663/1984.

Of these, the method of desalting the washed sugar liquor, known as the so-called improved reverse method, is the currently used refining method by ion exchange resins in which artifices are used for preventing contamination of the strongly basic anion exchange resin. These artifices include arranging a Na type strongly acidic cation exchange resin, a strongly basic anion exchange resin and a weakly acidic cation exchange resin in this order and conducting the regenerated waste liquid or the hydrochloric acid containing saline water from the weakly acidic cation exchange resin through the strongly basic ion exchange resin for preregeneration.

Although excellent in preventing contamination of the strongly basic anion exchange resin, this system has a drawback that it is of the load type or Cl type since the resin which ought to be used inherently in the isolated form is pre-regenerated with the hydrochloric acid containing saline water which is the regenerated waste liquid by the weakly acidic cation exchange resin. That is, this known system has a drawback that the efficiency of final regeneration by sodium hydroxide and the desalting efficiency are lowered. In addition, the ion exchange resin that has lost its desalting capacity has to be passed to the regenerating operation, even though it still has some decoloration capacity, which proves to be an inconvenience from the viewpoint of effective resin utilization.

For obviating this deficiency, an attempt has been made to divide the strongly basic anion exchange resin in two and to pre-regenerate only the former half resin while only finally regenerating the latter half resin. However, with this system, contamination of the latter half resin cannot be eliminated, such that it becomes necessary to obviate the problem of resin contamination every twentieth cycle by the pre-regenerative operation consisting in treating the resin with a hot hydrochloric acid and with a sodium hydroxide containing saline water in this sequence. The result is a complicated procedure and the necessity of using additional pre-regenerative agents.

SUMMARY OF THE INVENTION

It is therefore an object of the present invention to provide a process for refining a sugar liquor, according to which, through a pre-treating refining method for effectively and economically removing suspended materials, the refining capacity in the course of the ion exchange resin system may be drastically increased to provide for economical refining of a sugar liquor, such as unwashed sugar liquor, which has been impossible to achieve through the prior art technique.

It is another object of the present invention to provide a system for refining a sugar liquor wherein the desalting capacity is not lowered even when the totality of the ion exchange resin employed should be subjected to preregeneration.

It is a further object of the present invention to provide a process for refining a sugar liquor wherein the removal of impurities including decoloration and desalting may be performed efficiently and effectively.

As a result of our eager researches towards achieving the above objects, the present inventors have found that, by employing a novel refining technique by cristobalite and combining this technique with a refining method by the ion exchange resin, refining of sugar liquor and especially unwashed sugar liquor, which has been impossible to perform with the prior art technique, may now be performed economically.

The refining process for sugar liquor according to the present invention is characterized in that the sugar liquor is contacted with cristobalite and ion exchange resin in this order.

Cristobalite reacts specifically with various colloids or suspended materials and exhibits a superior effect of removing impurities unattainable with the conventional system, such as sand filtration.

On the other hand, the ion exchange resin exhibits superior decoloration and desalting properties with respect to coloring matter or salts contained in the sugar liquor.

Thus the combination of these two measures leads to a sugar refining system whereby even the unwashed sugar liquor may be refined.

The improved reverse system, which represents one of the desalting and refining techniques by ion exchange resins, has a drawback that it is of the load type or Cl type since the resin which ought to be used inherently in the isolated form is pre-regenerated with the hydrochloric acid containing saline water which is the regenerated waste liquid by the weakly acidic cation exchange resin. That is, this known system has a drawback that the efficiency of final regeneration by sodium hydroxide and the desalting efficiency are lowered.

In accordance with the present invention, there is provided a novel ion exchange refining system wherein three types of adsorption towers mainly containing the strongly basic anion exchange resin and the weakly acidic cation exchange resin (strongly basic anion exchange resin may be preceded by low basicity anion exchange resin and/or cation exchange resin). These three types of the adsorption towers are used as the pre-stage adsorption tower, post-stage adsorption tower and the adsorption tower for regeneration. The sugar liquor is continuously passed from the pre-stage adsorption tower to the post-stage adsorption tower. The lowering of the refining capacity of the post-stage adsorption tower is sensed to shift the pre-stage adsorption tower to the adsorption tower for regeneration, while simultaneously shifting the post-stage adsorption tower and the adsorption tower for regeneration to the pre-stage adsorption tower and to the post-stage adsorption tower, respectively.

When the three types of the adsorption towers, basically comprising strongly basic anion exchange resin and the weakly acidic cation exchange resin, wherein the strongly basic anion exchange resin may be preceded by the low basicity anion exchange resin and/or cation exchange resin, are cyclically shifted in the order of the pre-stage adsorption tower, adsorption tower for regeneration, post-stage adsorption tower and back to the pre-stage adsorption tower, the capacity of the (1) type strongly basic anion exchange resin may be exploited to the utmost while the function of adsorbing the colorants and removing anions may also be exhibited effectively.

On the other hand, the load of the strongly basic anion exchange resin may be alleviated by arranging the lower basicity anion exchange resin ahead of the strongly basic anion exchange resin and adopting a new regenerative method.

BRIEF DESCRIPTION OF THE DRAWINGS

FIG. 1 is a diagrammatic sectional view showing the arrangement of an ion exchange resin tower employed in the present invention.

FIGS. 2A to 2C are diagrammatic views showing an example of an ion exchange resin system applied to the present invention.

DETAILED DESCRIPTION OF THE INVENTION

Figure 3:
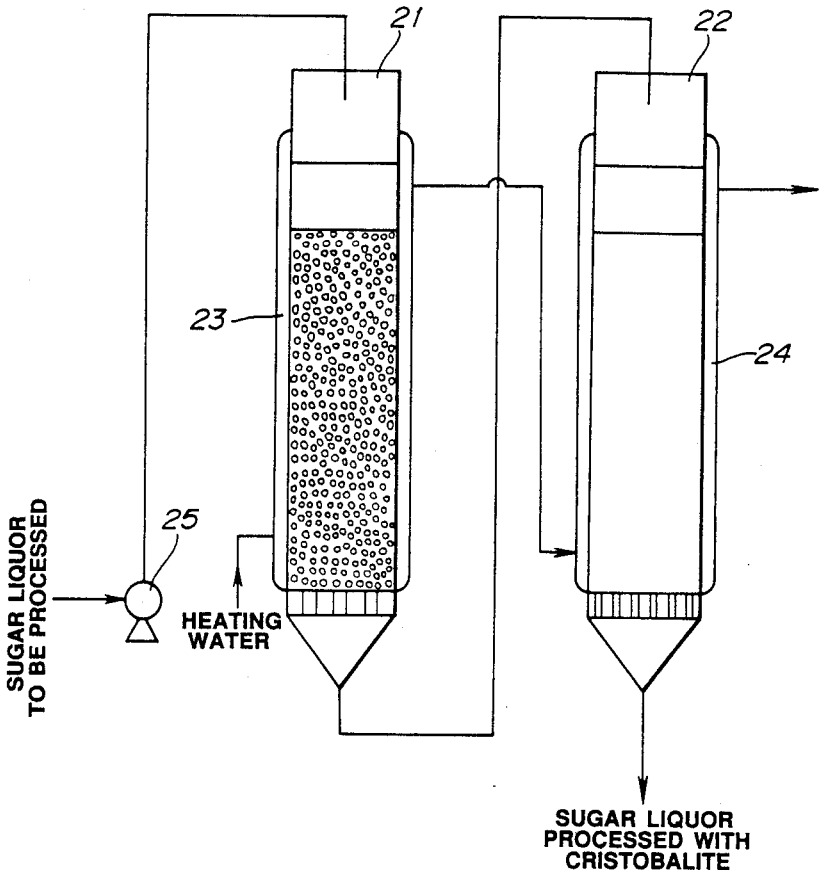
FIG. 3 is a diagrammatic view showing an example of a cristobalite filtration bed employed in an embodiment of the present invention.

This invention roughly consists of two techniques, the first of these being refining by cristobalite.

Cristobalite, a mineral having the same composition as quartz ($SiO_2$), differs from quartz in the molecular arrangement in the crystal, and is stable up to 1470° C. to 1700° C. and substable up to 230° C. or 250° C.

Cristobalite of natural origin, a regular octahedral crystal, is of the low temperature type or of the tetragonal system and is converted at 180° C. to 270° C. to the high temperature type or tesseral system. It is found in minute crystals in the interstices of andesite, but is also found at the base of rocks. In this nation, cristobalite is produced in Aomori-ken and commercially available from Nittetsu Kogyo Co. Ltd.

Cristobalite exhibits superior adsorbant properties with respect to impurities that cannot be removed by conventional refining methods, such as carbonation, clarification by phosphoric acid, treatment with powdered or granulated activated carbon or treatment with bone ashes, such that the capacity proper to each subsequent refining process may be synergistically increased. For example, decreased foaming in the course of carbonation is one of the outstanding effects. That is, cristobalite reacts specifically with impurities contained in the sugar liquor, especially with various colloidal or suspended materials, such as coloring matter or heavy metals, and functions to adsorb these impurities to the surface to exhibit the effect of adsorption superior to that of filtration proper to the filtration bed. The adsorption by cristobalite differs from the filtration, such as the filtration by sand, both in function and in operating procedure, such that an excellent effect of impurity filtration may be exhibited that compares favorably with conventional sand filtration. This effect presents itself most prominently with the use of cristobalite having the particle size ranging from 0.5 mm to 0.05 mm.

Although the mechanism of adsorption of impurities in the sugar liquor by cristobalite has not been clarified, it may be inferred that, since it is a porous silicic acid type mineral having the chemical composition of $SiO_2$, a pore size of 15 to 200 Å, a specific surface area of 110 to 130 $cm^2/g$ and a meshed structure composed of Si-O regular tetrahedrons three-dimensionally and infinitely, and contains numerous silanol groups (—Si—OH) on its surface, such adsorption is possibly ascribable to chemical attraction acting between these silanol groups and the impurity particles as agglomeration and also to physical attraction by deposition of cristobalite onto the surface or interior of the meshed structure of cristobalite.

Minerals of natural origin, such as sepiolite, attapulgite, parigorskite, serite or sirasu or synthetic minerals such as eliolite or florlite, have the structure similar to cristobalite, and exhibit certain adsorptive properties as does cristobalite. However, the adsorptive properties of these minerals is far inferior to cristobalite.

Among the methods for refining the sugar liquor by cristobalite are methods consisting in passing the sugar liquor through a filtration bed or adsorption tower packed with particulate cristobalite and/or contacting the sugar liquor with powdered cristobalite.

For removing sediments in the sugar liquor, the latter is heated to higher than 90° C. to produce the sediments which are then contacted and reacted with cristobalite for more effective removal. However, a certain amount of the sediments may be removed without heating However, such heating to higher than 90° C. is preferred since the bactericidal effects may be displayed simultaneously.

In the case of dilute sugar liquor, such as the sweet potatoe sugar juice or beet sugar juice, powdered cristobalite may be directly added to and reacted with the sugar liquor, or added simultaneously with defication for contact reaction. In either of these cases, filtration obstructive components may be removed effectively. Powdered cristobalite (specific gravity, 2) is precipitated with the sediments in the sugar liquor and with the filtration obstructive substances adsorbed thereto. It may also be applied simultaneously with defication. Rather, with the use of powdered cristobalite, it becomes possible to perform defication more effectively.

In the filters used in the process steps of the sugar refining system, diatomaceous earth etc. is used as the filtration assistive agent to improve the filtration efficiency. The method of replacing the diatomaceous earth and the powdered cristobalite with each other is an excellent method for removing filtration obstructive precursors and filtration obstructive substances.

The most effective method of applying the refining by sugar liquor includes forming a filtration bed or adsorption tower by particulate cristobalite and passing unwashed sugar liquor or low quality molasses containing a large amount of filtration obstructive substances therethrough. It becomes possible with this method to remove the "sediments" or "filtration obstructive substances" which could not be removed with the conventional process.

The sugar liquor containing such a large amount of impurities may be effectively processed in advance by, for example, centrifugal precipitation methods. However, such sugar liquor may be effectively passed through coarse, medium and fine size cristobalite layers for more effective removal of impurities. It would be most effective to pass the sugar liquor through these coarse, medium and fine size cristobalite layers and, more preferably, through a unitary filtration bed containing adsorptive layers packed with coarse, medium and fine size cristobalite particles. By the coarse, medium and fine size herein are meant the particle sizes of 0.5 to 10 mm, 0.1 to 1.0 mm and 0.01 to 0.5 mm, respectively.

When processing the sugar liquor with cristobalite by the above described method, it is most preferred to add alkalis such as Ca, Mg, Na or K or chitosan as flocculents to the sugar liquor and to heat the resulting mixture to produce colloidal substances, which are then processed with cristobalite. The impurities contained in the sugar liquor are adsorbed to cristobalite when the sugar liquor is passed therethrough at lower than a predetermined linear velocity. However, with increase in the linear velocity gradually, not only the impurities are not adsorbed, but the previously adsorbed impurities are desorbed. This is an indication that cristobalite can be easily regenerated and repeatedly used by countercurrent washing with, for example, water.

Although cristobalite can be regenerated in this manner by countercurrent washing with water to a certain extent, the impurities can be desorbed thereby only insufficiently, such that it is gradually lowered in its capacity until it is no longer usable as the adsorbant.

The present inventors have conducted numerous tentative regenerating operations for cristobalite that has been lowered in its adsorptive activity by difficultly desorbable substances such as high polymer colorants or suspended substances, and have acquired the following information.

That is, the present inventors have found that turbid materials that hitherto could be only difficultly desorbed from cristobalite may be easily desorbed with the use of an aqueous acid solution heated to not lower than 40° C. Of importance is the fact that the desorptive effects are prominent at elevated temperatures of not lower than 40° C., while the turbid materials are scarcely desorbed at ambient temperature.

At the elevated temperatures of not lower than 40° C., desorptive effects are not lowered markedly even with the lower acid concentration. If the temperature is not lower than 40° C., turbid materials may be desorbed at pH not higher than 2, that is, with a dilute solution, such as an aqueous solution of hydrochloric acid having the concentration of the order of 0.1%. The fact that regeneration may be feasible with a dilute solution means that the use of a lesser amount of the regenerant suffices with corresponding economic advantages.

The acids employed in the aqueous acid solution include hydrochloric acid, sulfuric acid, nitric acid, phosphoric acid, formic acid and acetic acid. Mineral acids, such as hydrochloric acid, are preferred for utmost effects. Dilute waste acid solutions produced during regeneration of the ion exchange resins may naturally be employed.

Besides the aqueous solutions, solutions in acid containing organic solvents may also be employed, according to the usage and application. Above all, acetone, methanol or ethanol solutions containing hydrochloric acid are preferred. Other organic solvents include chloroform, carbon tetrachloride and hexane. In this case, it is unnecessary to heat the solution, in a manner different from the aqueous solution, but a sufficient desorptive effect may be attained at ambient temperature.

The present inventors have also found that the coloring matter, above all, may be efficiently desorbed from cristobalite with use of an alkaline solution. However, since cristobalite is partially dissolved by alkali treatment with elution of silicic acid, it is not precisely known to which extent the desorptive activity of cristobalite may be restored following such alkali treatment. As a result of our investigations, the present inventors arrived at a conclusion that the adsorptive activity of cristobalite is substantially not lower than that before alkali treatment if the amount of elution of silicic acid is not more than 5% of the total weight of cristobalite.

The present inventors then sought for the condition under which, in the typical case of an aqueous solution of sodium hydroxide, the amount of silicic acid elution is not more than 5% of cristobalite. It has thus been found that, with the alkali concentration of not more than 0.5%, the amount of silicic acid elution may remain substantially unaffected by the operating temperature and, with the alkali concentration ranging between 0.5 and 1.0%, it is affected severely by temperature so that temperature control need be performed rigorously, while the temperature lower than ambient temperature is required for the alkali concentration of not less than 1.0%. Above all, the treatment is preferably performed at the temperature ranging between 30° C. and 40° C. using a dilute solution having the concentration of the order of 0.1 to 0.4%.

At any rate, it is quite natural that cristobalite may be used over a larger number of times of repetition if the treatment is conducted under milder processing conditions, while the number of times of repeated usage is lowered under more rigorous processing conditions. Therefore, in alkali processing, the processing conditions are preferably determined by taking account of the quality of the sugar liquor to be processed or the degree of contamination of cristobalite. It would also be advisable to perform the processing at intervals of two to five operations.

The alkalis used in the alkali solution include sodium hydroxide, potassium hydroxide and ammoniac water. The alkali solution may also be admixed with salts, such as sodium chloride. Dilute waste alkali water produced during regeneration of ion exchange resis may also be used, as in the case of the aqueous acid solution. Besides aqueous solutions, alkali-containing organic solvents may also be used according to usages and application.

As explained hereinabove, the regenerative operation with an acid solution heated to higher than 40° C. is effective as long as cristobalite which is lowered in its adsorptive capacity due to removal mainly of turbid substances as impurities is concerned, whereas the regenerative operation with an alkali solution under the condition such that the amount of dissolved silicic acid accounts for not more than 5% of the total weight of cristobalite is effective as long as cristobalite which is lowered in its adsorptive capacity due to removal mainly of the colorants as impurities is concerned. For example, for cristobalite that is lowered in its adsorptive capacity through removal of both the turbid matter and the colorant, it is preferred to use acid treatment and alkali treatment simultaneously. In this case, an acid processing may be preceded or followed by alkali processing, as desired.

The second important technique in the present invention resides in the decoloration and desalting by the ion exchange resin.

The ion exchange resins may include strongly basic anion exchange resin, medium basic anion exchange resin, weakly basic anion exchange resin, strongly acidic cation exchange resin, medium acidic cation exchange resin, weakly acidic cation exchange resin, either alone or in combination. These resins may be in the powdered or particulate form, as desired.

For example, a so-called reverse system, according to which a sugar liquor is first contacted with a hydroxy group type strongly basic anion exchange resin (tower A) for decoloration and deanionation and then with an H type weakly acidic cation exchange resin (tower K) for desalting, a mixed bed system according to which these two ion exchange resins are used as a mixture, or a so-called improved reverse system according to which a mixed bed containing the strongly acidic cation exchange resin and the strongly basic anion exchange resin (tower M) is installed ahead of the reverse system, is preferred.

Meanwhile, what are of utmost concern when desalting and refining the sugar liquor by the ion exchange resin is the lowered capacity of the ion exchange resin employed and the measures to prevent the capacity from being lowered.

Therefore, among the aforementioned systems, the improved reverse system is most preferred, since the technique is adopted threin to prevent contamination of the strongly basic anion exchange resin.

The improved reverse system basically resides in arranging the weakly acidic anion exchange resin, using the hydrochloric acid containing saline water as the regenerant for the weakly acidic anion exchange resin and passing the waste regenerating liquid to the strong basic anion exchange resin for pre-regenerating the resin. When the sugar liquor is to be decolored, desalted or desilicated for refining by first contacting it with the hydroxy type strongly basic anion exchange resin and then with the H type weakly acidic anion exchange resin, for thereby reducing the source of contamination of the anion exchange resin by the alkali metal salt type cation exchange resin, and regenerating the anion exchange resin, the regenerated liquid effluent produced during the regenerating process for the weakly acidic anion exchange resin is passed sequentially through the anion exchange resin by way of preliminary regeneration, and the alkali liquid is then passed therethrough by way of final regeneration. This method is most preferred in preventing the contamination of the strongly basic anion exchange resin.

In a usual regenerative method employing sodium hydroxide in general, the colorant adsorbed to the anion exchange resin is not desorbed completely, but is gradually accumulated in larger amounts in the resin. The feature of the improved reverse system resides in that the regenerated liquid effluent from the weakly acidic cation exchange resin of the tower K is passed through the tower M to desorb as much colorant substances accumulated in the anion exchange resin in the tower M as possible by way of pre-regeneration. This results in a markedly increased amount of desorbed colorant and a reduced amount of colorant accumulated in the resin. It is also said that the improved reverse system allows to process more sugar liquor than in the conventional method and is superior in desalting and decoloration properties.

On the other hand, the improved reverse system, which represents one of the desalting and refining techniques by ion exchange resins, has a drawback that it is of the load type or Cl type since the resin which ought to be used inherently in the isolated form is pre-regenerated with the hydrochloric acid containing saline water which is the regenerated waste liquid by the weakly acidic cation exchange resin. That is, this known system has a drawback that the efficiency of final regeneration by sodium hydroxide and the desalting efficiency are lowered.

Thus, there may be provided a novel ion exchange refining system wherein three types of adsorption towers mainly containing the strongly basic anion exchange resin and the weakly acidic cation exchange resin (strongly basic anion exchange resin may be preceded by low basicity anion exchange resin and/or cation exchange resin). These three types of the adsorption towers may be used as the pre-stage adsorption tower, post-stage adsorption tower and the adsorption tower for regeneration. The sugar liquor may be continuously passed from the pre-stage adsorption tower to the post-stage adsorption tower. The lowering of the refining capacity of the post-stage adsorption tower may be sensed to shift the pre-stage adsorption tower to the adsorption tower for regeneration, while simultaneously shifting the post-stage adsorption tower and the adsorption tower for regeneration to the pre-stage adsorption tower and to the post-stage adsorption tower respectively.

The strongly basic anion exchange resin used herein is the (1) type strongly basic anion exchange resin in which the exchange group is the quaternary ammonium group, and may be exemplified by Diaion PA 308, Amberlite IRA 900, Dowex XUS 40240, Levertit MP-500 (trade names).

The weakly acidic cation exchange resin is the cation exchange in which the exchange group is the carboxyl group, and may be exemplified by Diaion WK11, 12 and 20, Amberlite IRC 50 and Levertit CNP 80 (trade names).

The strongly basic anion exchange resin may be optionally preceded by low basicity anion exchange resin (and also cation exchange resin). The low basicity anion exchange resin is the so called (2) type strongly basic, medium basic or weakly basic ion exchange resin having the tertiary ammonium group as the exchange group, such as, for example. Diaion PA 418 and 408, Amberlite IRA 910, Dowex XUS 40189, Levertit MP 600 and AP 49, or having the secondary or primary ammonium group as the exchange group, such as Diaion WA 30, 20 and 10, Amberlite IRA 93 and Levertit MP 62.

The indication cation exchange resin herein means the totality of cation exchange resins ranging from the strongly cation exchange resins having sulfonyl groups as exchange groups to the weakly acidic cation exchange resins.

This ion exchange resin refining system has the feature such that its desalting capacity is not lowered even when it is used for pre-regenerating the totality of the anion exchange resins used for preventing the contamination of the strongly basic anion exchange resin, which has many disadvantages, so that the process capacity may be improved significantly. The concrete structure of the system is explained in more detail hereinbelow.

In the present system, a smooth resin operation may be achieved by partitioning the resin tower by suitable partitioning plates.

As shown for example in FIG. 1, the resin tower employed in the present system is packed with a cation exchange resin 1, a (2)- type strongly basic anion exchange resin 2, a (1) type strongly basic anion exchange resin 3 and a weakly acidic cation exchange resin 4 in this order from the bottom side. This is however merely illustrative and the tower may be packed only with a (1) type strongly basic anion exchange resin 3 and a weakly acidic cation exchange resin 4, or with a (2) type strongly basic anion exchange resin 2, a (1) type strongly basic anion exchange resin 3 and a weakly acidic cation exchange resin 4.

Three towers each packed with these four kinds of resins, namely a first resin tower 11, a second resin tower 12 and a third resin tower 13, are provided, as shown in FIG. 2A.

In the refining process, the sugar liquor is supplied from the lower side of the first resin tower 11 to flow as an ascending stream therethrough. The liquid effluent from the top of the first resin tower 11 of the preceding stage is continuously supplied from the lower end of the second resin tower of the succeeding stage to flow therethrough in the similar manner. The third resin tower 13 is used in the regenerative process. The first resin tower 11 is transferred to the regenerative process at the time point when the ash contents in the liquid effluent from the second resin tower 12 are equal to about 0.01% (10 $\mu$S/cm in terms of electrical conductivity EC). It is also advisable to shift the tower to the regenerative process by the processing multiple per resin amount on the basis of the assumed through-flow point. At this time, the anion exchange resin in the first resin tower 11 as the preceding process is loaded so severely that the shifting has been made therein from the isolated type to the load type.

At this time, only the first resin tower 11 enters into the regenerative process, while the liquid passage through the second resin tower 12 is continued. At this time, the second resin tower 12 is of the preceding stage and the previously regenerated third resin tower 13 is of the succeeding stage. The liquid conduction is performed in the similar manner for refining.

The first resin tower 11 which has entered into the regenerative process is freed of sugar and rinsed by hot water supplied as the descending stream from the top of the resin tower.

After completion of rinsing, a 1 to 10% aqueous solution X of mineral acid, preferably hydrochloric acid, heated to higher than 40° C., is supplied from an upper supply port 11*a* as a descending stream and the effluent liquid is discharged from the bottom side, in order to regenerate the weakly acidic cation exchange resin 4, (1) type basic anion exchange resin 3, (2) type strongly basic anion exchange resin 2 and the cation exchange resin 1 in this sequence. Since the multi-tier system is used herein, the above solution X is previously heated to not lower than 40° C. so that the temperature of not lower than 40° C. is maintained at the time when the solution contacts with the (1) type strongly basic anion exchange resin. However, since heating of the solution is unnecessary at the time of contact thereof with the weakly acidic cation exchange resin 4, the reproducing liquid effluent from the weakly acidic anion exchange resin tower may be heated to not lower than 40° C. before being supplied to the (1) type strongly basic anion exchange resin tower and the subsequent resin towers, especially in case of a multi-tower system. At any rate, the cation exchange resin and the anion exchange resin shift to the H type and the load or Cl type, respectively, as a result of the present operation. Since the resin in the first resin tower 11 has already adsorbed impurities contained in the sugar liquor almost to saturation, no negative effect caused by the anion exchange resin being turned into the Cl type is noticed. By this operation, the impurities, mainly the colorant substances, are removed nearly completely. The present operation is the pre-regenerative operation.

Hydrochloric acid, the pre-regenerating agent, is displaced by hot water and the first resin tower 11 is rinsed. The final regenerating operation with an alkali hydroxide is then initiated. That is, a 1–10% aqueous solution Y of sodium hydroxide is passed at 40° C. to 50° C. as a descending stream via a distributor **11*b* at a lower portion of a partitioning plate between the weakly acidic cation exchange resin 4 and the (1) type strongly basic anion exchange resin 3 so as to be contacted with the (1) type strongly basic anion exchange resin 3, (2) type strongly basic anion exchange resin 2 and the cation exchange resin 1, in this sequence, without however being contacted with the weakly acidic cation exchange resin 4. By this operation, the anion exchange resins 2 and 3 are turned into OH type, while the residue is turned into Cl type. The cation exchange resin 1 is turned into Na type to take charge of softening the sugar liquor during the refining process and, more importantly, turning the reproducing liquid effluent from the weakly acidic cation exchange resin 4** into the HCl-containing NaCl water.

By the similar sequence of operations, the second resin tower 12 is shifted to the regenerating process at the time point when the ash contents in the liquid effluent from the third resin tower 13 are about 0.01%, such that the third resin tower 13 is now at the preceding stage and the previously regenerated first resin tower 11 is at the succeeding stage.

The mechanism of decoloration by the anion exchange resin has not been clarified, such that, when utilizing the hydroxy group type strongly basic anion exchange resin, the conventional practice has been to perform the operation under the assumption that the decoloration capacity has been lowered in conjunction with lowering of the desalting capacity. Thus the resin in its entirety was shifted to the regenerating process based on the sensed lowering of the desalting capacity.

Concerning the decoloration by the anion exchange resin, the higher the basicity, the higher its decoloration capacity. Hence, it was thought to be meaningless to provide the weakly basic resin or the medium basic resin at the preceding stage with a view to enhancing the decoloration capacity of the strongly basic anion exchange resin.

In practice, the sugar liquor to be treated by the ion exchange resin process utilized in sugar refinery is already refined by a variety of refining steps and is usually brought to a low color value A.I. of not higher than 200. In such case, effect of the decoloration resulting from placing the low basicity resin right ahead of the strongly basic anion exchange resin is not noticed. It is however thought that it is meaningful to provide the medium basic anion exchange resin and the weakly basic anion exchange resin at a position ahead of the strongly basic anion exchange resin in order to relieve the latter of the desalting load, while it is also thought to be meaningful to regenerate these resins with the reproducing liquid effluent from the strongly basic anion exchange resin.

For preventing the contamination of the strongly basic anion exchange resin, it is desirable to improve the pre-regenerative step of the improved reverse process so as to pre-regenerate the strongly basic anion exchange resin in its entirety. It is therefore necessary to make full use of the advantages of the pre-regeneration to improve the desalting capacity of the overall system through obviating the inconvenience that the strongly basic anion exchange resin is turned into the load type by the pre-regeneration. In the present system while the low basicity resin is used simultaneously for improving the desalting capacity, the decoloration efficiency has been improved more significantly than the desalting capacity by using this type of resin simultaneously. This decoloration effect was truly surprising and beyond our expectation. The present system, demonstrating this decoloration effect throughout many cycles makes it possible to refine the unwashed sugar liquor, for example, when the system is combined with the above described refining or pre-processing with cristobalite, due to the synergistic effects.

In practice, the finally refined sugar liquor or fine liquor, which is pre-processed with cristobalite and then desalted and refined finally by the present system, is of significantly higher quality, in respect of the coloring matter, ashes etc. than the fine liquor produced by the currently practiced technique for refining washed sugar liquor.

While it is difficult to analyze logically the phenomenon of the decoloration mechanism by the ion exchange resin, which itself has not been clarified, it may be inferred that the high polymer colorants are contained in a larger amount in the unwashed sugar liquor and that these colorants are reacted with the low basicity anion exchange resin and thereby removed effectively. This adsorptive action is probably performed by physical adsorption. In the case of the usual sugar refining technique, employing the washed sugar liquor as the starting material, the feed sugar liquor to the ion exchange resin process is the refined liquor after decoloration by various refining process steps. There are no high polymer colorants in this refined liquor such that the low basicity ion exchange resin is not necessitated. This possibly accounts for the overlooking of this critical ion exchange resin. Therefore, in such case, it is not always necessary to use the low basicity anion exchange resin simultaneously. It has been demonstrated that this also gives rise to results superior to those of the conventional methods. Although this result has been beyond our expectation, since the increase in the desalting capacity is attained as a natural consequence, pre-regeneration of the totality of the strongly basic anion exchange resin is performed in the present system for obviating the deficiency of the prior art technique. Optimum results in preventing the resin contamination have been obtained, as anticipated.

A new tentative regenerative method has also been performed, according to which the regenerative liquid effluent of hydrochloric acid from the weakly acidic cation exchange resin is passed through the strongly basic anion exchange resin and the regenerating liquid effluent is again passed through the aforementioned low basicity anion exchange resin. It has been found that the result was beyond our expectation and the majority of the adsorbed colorants could be desorbed. One of the possible reasons for this unexpected result is that the composition of the regenerating liquid effluent of hydrochloric acid of the weakly acidic cation exchange resin is changed, that is, the table salt concentration is increased.

The above described ion exchange resin refining system allows to decolor and desalt the washed sugar liquor efficiently for refining. It may also be combined with the well-known pre-processing process, such as carbonation, processing by active carbon, clarification by phosphoric acid or sand filtration or with pre-processing with cristobalite to make possible the refining of sugar liquor or molasses which has not been feasible with the prior-art system. The sugar liquor means the liquor containing the sweet components derived from vegetable components such as sweet potato sugar, beet sugar or starch sugar. Such liquor is characterized by the contents therein of various components derived from plants or soil as impurities. The field of art in which the present invention may be applied with utmost industrial merits is the refining of the unwashed sugar liquor combined with the aforementioned pre-processing step. However, the present invention may also be applied to the refining of the washed sugar liquor, various molasses and solutions containing colloidal or suspended substances.

When the unwashed sugar liquor is refined by the aforementioned technique to produce the fine liquor, an ion chromatographic separating method is additionally performed for effective recovery of the sucrose fraction contained in the molasses after recovery of crystal sugar from the fine liquor.

In general, if excess amounts of Ca and Mg are contained in the treated sugar liquor, it is difficult to perform ion chromatographic separation. However, since the amounts of Ca and Mg contained in the molasses produced from the fine liquor refined upon contact with cristobalite and the ion exchange resin are not higher than 500 ppm, the various components may be isolated by ion chromatography without requiring any pretreatment. Hence, after recovery of crystal sugar from the fine liquor refined on contact with cristobalite and ion exchange resin, sucrose and invert sugar existing in molasses may be fractionated by ion chromatographic separation to restore the sucrose fraction to sugar liquor from which crystal sugar can be recovered to improve the recovery rate of crystal sugar.

The ion chromatograph separation is based on utilizing the difference in affinities between sucrose and invert sugar with respect to Na or Ca type strongly acidic cation exchange resin used as a separating agent. It may be exemplified by a batch separation method by a simple fixed bed, a moving bed type continuous separation or pseudo moving bed type continuous separation. For large scale production, the moving bed type continuous separation or pseudo moving type continuous separation is preferred.

It will be appreciated from the foregoing that the present invention reside in a combination of processing by cristobalite and processing by the ion exchange resin and has many advantages such as complete and economical desalting, decoloration and decolloidation of raw sugar. The present invention has a great technological significance that the new refining technique for unwashed sugar liquor has been achieved. However, the effects of the present invention may naturally be displayed on application to washed sugar liquor or various other sugar liquors. As the effects in this case, the process, product quality and operability may be improved.

On the other hand, complete desalting of the processed sugar liquor according to the present invention means not only the improved recovery rate of crystal sugar but also the enhanced utility of the molasses remaining after recovery of the crystal sugar. In recent days, the usage for refined molasses is decreased and the way for disposal is restricted. This means that the complete utilization of the waste molasses has a great significance not only industrially but in connection with pollution problems.

The present invention is explained with reference to illustrative Examples. However, these Examples are by way of illustration only and are not to be interpreted in the limiting sense.

First, for investigating into the refining and regenerative effect of cristobalite on sugar liquor, the following preliminary tests were conducted.

PRELIMINARY EXAMPLE 1

The construction of the filtration bed employed in the present experiment is first explained.

As shown in FIG. 3, the filtration bed employed in the present experiment in composed basically of a first filtration bed 21 packed with particulate cristobalite with the particle size of 0.6 to 2.0 mm and a second filtration bed 22 packed with particulate cristobalite with the lesser particle size of 0.3 to 0.6 mm. In the present experiment, the particulate cristobalite produced by Nittetsu Kogyo Co. Ltd. under the trade name of "Crisbal G 700" was used as the particulate cristobalite packed in the first filtration bed 21 and the particulate cristobalite produced by Nittetsu Kogyo Co. Ltd. under the trade name of "Crisbal G 300" was used as the particulate cristobalite packed in the second filtration bed 22.

Each of the filtration beds 21, 22 is surrounded by water jackets 23, 24 through which heating water is circulated for heating the inside of the beds 21, 22.

The sugar liquor to be processed is supplied via pump 25 to the first filtration bed 21 and, after processing therein to some extent, is passed through the second filtration bed 22 so as to be taken out at the bottom of the bed 22 as the processed sugar liquor.

Using the above described filtration beds, the following experiments were conducted.

Waste molasses produced from a sugar refinery were prepared to Bx. 58 and adjusted to pH of 6.4 by addition of sodium hydroxide. The resulting molasses was heated to 90° C.

The molasses was then cooled to 60° C. and passed as a descending stream at 60° C. and S.V 1 through the cristobalite layers of the filtration bed shown in FIG. 1.

The molasses was processed in an amount about 30 times that of cristobalite, so that the filtration pressure or differential pressure was increased to not less than 2 $kg/cm^2$. The passage of the molasses was terminated and the molasses were freed of sugar using hot water.

The filtration performance and the amount of the formed sediments were measured of the molasses processed with cristobalite. The following analytic method was used.

Filtration Performance: After the molasses to be tested was adjusted to Bx. 50, a filter paper No. 2 was loaded into a constant pressure filtration tester (produced by Toyo Kagaku Co. Ltd.; filtration area, 10 $cm^2$) and filtration was performed under a pressure of 1 kg/cm$^2$ to find the time involved in filtering 200 ml of the molasses.

Composition of the Sediments: After the sugar molasses to be tested was adjusted to Bx. 500 and boiled for one minute, the molasses was passed to a measuring cylinder of 100 ml capacity, which was placed stationarily in a constant temperature vessel maintained at 38° C. for 15 hours. The composition of the components at the lower layer of the sediment-containing molasses was indicated as the amount of sediments in percentages.

Bx, pH, apparent pure sugar ratio and color value were measured as conventionally in accordance with the teaching contained in "Sugar Making Manual" published by Asakura Printing Co. Ltd. The results are shown in Table 1.

TABLE 1

| | Filtration Properties | Sediment | Bx | pH | Apparent Pure Sugar Rateio | Color Value (A.I) |
|---|---|---|---|---|---|---|
| Sugar Liquor to be Processed (Waste Molasses) | Filtration Impossible | 22% | 57 | 6.4 | 30.2 | 191,951 |
| Sugar Liquor Processed | 80 sec | 0% | 55 | 5.8 | 31.4 | 163,836 |

PRELIMINARY EXPERIMENT 2

6000 ml of washed molasses from sugar refinery (Bx. 60) was passed as an ascending stream through a cristobal filtration bed (bottom surface area, 15 cm$^2$; layer height, 20 cm; cristobalite, produced by Nittetsu Kogyo Co. Ltd. under the trade name of "Crisbal G300") at the rate of 300 ml/hour as the molasses were heated to 70° C. The molasses thus processed was analyzed in the same manner as in the Preliminary Experiment 1. The results are shown in Table 2.

TABLE 2

| | Filtration Properties | Sediment | Bx | pH | Apparent Pure Sugar Ratio | Color Value (A.I) |
|---|---|---|---|---|---|---|
| Sugar Liquor to be Processed (Waste Molasses) | Filtration Impossible | 5% | 60 | 5.6 | 72.3 | 60,939 |
| Sugar Liquor Processed | 40 sec | 0% | 58 | 5.5 | 73.0 | 49,365 |

PRELIMINARY EXPERIMENT 3

Particlate cristobalite having the particle size of 10 to 100 μm was precoated in a Nutsche type test filter (effective filtration area, 10 cm$^2$) to a thickness of 1 cm, 500 ml of raw sugar produced in Okinawa-ken, Japan were dissolved to Bx. 50 and passed through the filter at 70° C. The properties of the sugar liquor thus processed were measured in the same way as in Preliminary Experiments 1 and 2. The results are shown in Table 3.

TABLE 3

| | Filtration Properties | Sediment | Bx | pH | Apparent Pure Sugar Ratio | Color Value (A.I) |
|---|---|---|---|---|---|---|
| Sugar Liquor to be Processed (Waste Molasses) | 150 sec | 0.2% | 51 | 5.3 | 97.50 | 6,559 |
| Sugar Liquor Processed | 40 sec | 0% | 50 | 5.3 | 97.55 | 4,542 |

PRELIMINARY EXPERIMENT 4

500 ml of low quality sweet potatoe juice were sampled in a Torr beaker and admixed with lime milk to adjust the pH to 7.

On the other hand, sweet potatoe juice produced in the similar manner was admixed with 1 g of powdered cristobalite produced by Nittetsu Kogyo Co. Ltd. under the trade name of "Crisbal PW-300" (particle size, not more than 100 μm) to produce a sugar juice.

These two kinds of the sugar juices were heated by an electric heater to close to ebullition and allowed to stand stationarily to check the difference in precipitation properties between the supernatant upper layer and the sludge.

As a result, the sugar juice admixed with cristobalite showed a faster precipitation speed as long as the sludge part is concerned, so that the supernatant and the precipitated part were separated clearly from each other in only 20 minutes. Conversely, the sugar juice subjected to usual defication showed only incomplete separation therebetween after lapse of one hour.

PRELIMINARY EXPERIMENT 5

300 g of previously chemically treated cristobalite produced by Nittetsu Kogyo Co. Ltd. under the trade name of WGL-300, were introduced into a 6×30 cm column fitted with an outer tube and heated to 60° C. 6000 ml of Waste molasses Bx 50 from sugar refinery were supplied through the column at the flow rate of 300 ml/hr as a descending stream for treatment. The packing was washed with water by countercurrent washing to free cristobalite of turbid materials affixed thereto. The above sequence of operations was repeated ten times to produce cristobalite that is lowered in its adsorptive capacity.

30 ml of this cristobalite (dry weight, 20 g) were introduced into a column fitted with an outer tube and 100 ml of an aqueous solution of hydrochloric acid were passed therethrough under various conditions shown in Table 4. This liquid effluent of hydrochloric acid was neutralized to pH 7 and non-colloidal substances, such as metal hydroxides, were collected on a glass fiber paper (DP-70, 0.6 m) and dried at 105° to 110° C. for 2 hours. The weight of the dried solid substance was measured to find the desorbed amount of the turbid materials. The results are shown in Table 4.

It is seen from Table 4 that the desorbed amount of the turbid materials was increased abruptly when the concentration of hydrochloric acid rose beyond 0.1% (pH, 2.0) and the processing temperature rose beyond 40° C.

TABLE 4

| conc. of hydrochloric acid (%) | pH | operat. temp. (°C.) | desorbed amount of turbid materials (mg) |
|---|---|---|---|
| 0.01 | 3.0 | 60 | 5 |
| 0.05 | 2.2 | 60 | 8 |
| 0.10 | 2.0 | 60 | 20 |
| 0.20 | 1.5 | 60 | 23 |
| 0.50 | 1.2 | 60 | 25 |
| 1.00 | 1.0 | 60 | 27 |
| 2.00 | 0.8 | 60 | 28 |
| 0.50 | 1.2 | 25 | 5 |
| 0.50 | 1.2 | 30 | 6 |
| 0.50 | 1.2 | 35 | 9 |
| 0.50 | 1.2 | 40 | 17 |
| 0.50 | 1.2 | 45 | 18 |
| 0.50 | 1.2 | 50 | 20 |
| 0.50 | 1.2 | 60 | 25 |

PRELIMINARY EXPERIMENT 6

Cristobalite was prepared in the same way as in the Preliminary Experiment 5. 100 ml of an aqueous solution of sodium hydroxide were passed through 30 ml (dry weight: 20 g) of this cristobalite, under the conditions shown in Table 5, as in Preliminary Experiment 5. As the liquid effluent of sodium hydroxide was neutralized to pH 7 and allowed to stand for one day, a silicic acid sol was precipitated. This silicic acid sol was collected by precipitation and, as in Preliminary Experiment 5, the amount of the dried solid substance was found as the eluted amount of silicic acid. On the other hand, the supernatant was diluted in 1 liter, and, using a cell of 1 cm, the light absorbancy at 420 nm was measured. The desorbed amount of the colorant shown in Table 5 is indicated by relative index with the desorbed amount of the colorants desorbed under the regenerating condition of the processing temperature of 30° C. and the NaOH concentration of 0.20% as the reference. The rate of dissolution is found in percentage as the ratio of the eluted amount of silicic acid per dried weight of cristobalite. The results are shown in Table 5.

It is seen from Table 5 that the higher the NaOH concentration and the higher the processing temperature, the more drastically the eluted amount of silicic acid is increased. The influence of the processing temperature becomes outstanding above all at higher than 0.50% concentration. On the other hand, the desorbed amount of the colorant is converged to a certain value and is not increased further even when both the NaOH concentration and the processing temperature are increased.

TABLE 5

| NaOH conc. (%) | pH | operat. temp. (°C.) | elution of silicic acid (g) | rate of dissolution (%) | relative index of desorbed colorant |
|---|---|---|---|---|---|
| 0.20 | 12.40 | 30 | 0.15 | 0.75 | 100 |
| | | 40 | 0.18 | 0.90 | 121 |
| | | 50 | 0.31 | 1.55 | 133 |
| | | 60 | 0.44 | 2.20 | 140 |
| 0.50 | 12.84 | 30 | 0.46 | 2.30 | 140 |
| | | 40 | 0.67 | 3.35 | 144 |
| | | 50 | 0.79 | 3.95 | 146 |
| | | 60 | 0.96 | 4.80 | 147 |
| 1.00 | 13.20 | 30 | 0.81 | 4.05 | 146 |
| | | 40 | 1.07 | 5.35 | 147 |
| | | 50 | 1.39 | 6.95 | 149 |
| | | 60 | 1.85 | 9.25 | 150 |

PRELIMINARY EXPERIMENT 7

200 g of cristobalite WGL-300 (trade name) were packed in the device similar to that employed in the Preliminary Experiment 5 and heated to 60° C. 600 ml of washed molasses Bx 50 from sugar refinery were supplied through the device as a descending stream at the rate of 300 ml/hr for treatment. Then, after countercurrent washing with water, regeneration was performed at 60° C. using 1 liter, of various regenerants shown in Table 6. Washed molasses was again processed in the similar manner, using the thus regenerated cristobalite. The qualities of the processed sugar solutions are shown in Table 6. The method for analysis is as shown below.

The Color Value (A. I.): The color value is measured as conventionally in accordance with the information found in Sugar Manual, published by Asakura Shoten.

Mass of Suspended Substances: The sugar liquor to be tested was centrifuged at 7000 G for 10 minutes. After discarding the supernatant and washing with water, the remaining product was dried for two hours to find the mass of the suspended substances as the dried solid matter.

Amount of Sediments: The sugar solution was adjusted to Bx 50 and boiled for one minute. The sugar liquor was then transferred into a measuring cylinder cf 100 ml capacity which was then placed stationarily in a constant temperature vessel of 38° C. for 15 hours. The amounts of the sediments product at this time were indicated by volume percentage as the amounts of sediments produced.

Filtration Performance: After adjusting the test sugar liquor to Bx 50, a filter paper (Toyo No. 2) was attached to a constant pressure test filter manufactured by Toyo Kagaku Co. Ltd.; filtration area, 10 $cm^2$) and filtration under pressure was performed at 1 $kg/cm^2$ to find the time involved in filtering 200 ml of the test sugar liquor. For sugar liquor exhibiting poor filterability, the filtration performance was indicated by the amount of filtration produced in two minutes.

The method for composite regeneration employing two regenerants as shown in Table 6 is indicated below.

Composite Regenerative Method (NH): After passing 1 lit. of 0.20 %—aqueous solution of sodium hydroxide, extrusion was made with 500 ml of water, and then 1 lit. of a 0.50%—aqueous solution of hydrochloric acid was passed.

Composite Regenerative Method (HN): After passing 1 lit. of a 0.50%—aqueous solution of hydrochloric acid, extrusion was made with 500 ml of water, and then 1 lit. of a 0.20%—aqueous solution of sodium hydroxide was passed.

TABLE 6

| Regenerative Operation | Color Value (A.I) | Mass of Suspended Substance in Processed Sugar Liquor (g/l) | Amount of Sediments (%) | Filtration Performance |
|---|---|---|---|---|
| 0.50% - aqueous solution of HCl (pH, 1.2) | 58180 | 0.08 | 0.1 | 27 sec |
| 0.20% - aqueous solution of NaOH (rate of silicic acid solution, 2.20%) | 53660 | 0.30 | 0.2 | 35 sec |
| 0.50% - aqueous | 53010 | 0.31 | 0.2 | 36 sec |

TABLE 6-continued

| Regenerative Operation | Color Value (A.I) | Mass of Suspended Substance in Processed Sugar Liquor (g/l) | Amount of Sediments (%) | Filtration Performance |
|---|---|---|---|---|
| solution of NaOH (rate of silicic acid dissolution, 4,80%) | | | | |
| 1.00% aqueous solution of NaOH (rate of silicic acid dissolution, 9.25%) | 62060 | 1.87 | 5.7 | 27 ml/2M |
| 5% - aqueous solution of NaCl | 63360 | 1.42 | 2.5 | 40 ml/2M |
| Composite Regeneration (NH) | 52385 | 0.05 | 0 | 25 sec |
| Composite Regeneration (HN) | 52370 | 0.05 | 0 | 25 sec |
| Unprocessed | 63950 | 2.84 | 7.3 | 15 ml/2M |
| Feed of Washed Molasses | 64650 | 3.44 | 10.5 | 8 ml/2M |

For investigating into the desalting and decoloring effects by the ion exchange resin refining system shown in FIGS. 2A to 2C, the following preminary experiments and comparative experiments were conducted.

PRELIMINARY EXPERIMENT 8

The washed sugar produced from the sugar washing process of the sugar refinery was processed with the sugar washing process shown below to produce the refined sugar liquor.

Sugar Washing→Carbonation (A)→Resin Processing (B).

The following processing conditions were used in the respective refining processes.

(A) Carbonation

The sugar liquor to be processed was maintained at 60° C. and lime milk (Bx 20) was injected thereinto until the pH value reached 9.2. Then, $CO_2$ diluted with air was injected thereinto immediately. The amounts of injection of lime milk and $CO_2$ were then adjusted so that the pH value was about 9.2. After adding lime milk in a predetermined amount (1% of CaO relative to the solid contents in case of raw sugar, and 0.5% in case of washed sugar), the temperature was raised to 70° C., while $CO_2$ injection was continued until the pH value was lowered to 8.0. After this status was maintained for 30 minutes, the pH value was adjusted to 7.0 by addition of a 10%—phosphoric acid solution. The filtration with diatomaceous earth was then performed to produce the supernatant liquid.

(B) Resin Processing

The sugar liquor to be processed was passed at 40° C. through the ion exchange resin system shown in FIGS. 2A to 2C. The following ion exchange resins were packed in the respective resin towers:

Diaion WK 20 (cation exchange resin)

Dowex XUS—40189 ((2)—type strongly basic anion exchange resin)

Dowex XUS—40240 ((1)—type strongly basic anion exchange resin)

Diaion WK 11 and 12 (weakly acidic cation exchange resin)

Table 1 shows the quality of the refined sugar liquor from the respective refining processes. In the resin processing method (B), the liquid effluents from the tower five cycles before and after were sampled. The color value index (A. I.), decoloration rate and colorant desorption rate were found in the following manner:

$$\text{Color Value Index } (A.\ I.) = \frac{O.D._{420} \times 1000}{b \times c}$$

wherein b stands for the cell length in cm, c stands for the weight of the solid contents in the tested sample (g/ml) and $O.D._{420}$ stands for the light absorbance at 420 nm.

$$\text{decoloration Rate} = \left(1 - \frac{\text{Color Value Index of Processed Sugar Liquor}}{\text{Color Value Index of Raw Sugar (Washed Sugar) Dissolving Liquid}}\right) \times 100(\%)$$

$$\text{Colorant Desorption Rate} = \frac{\text{Amount of Desorbed Colorant}}{\text{Amount of Adsorbed Colorant}} \times 100(\%)$$

$$= \frac{\text{Amount of Colorant in Regenerating Discharge Liquid}}{\text{Amount of Colorant Adsorbed by Resin}} \times 100$$

$$= \frac{O.D._w \times V_1}{(O.D._{in} - O.D._{out}) \times V_2}$$

wherein $O.D._{in}$ stands for light absorbance of the sugar liquor to be processed, $O.D._{out}$ stands for light absorbance of the processed sugar liquor, $O.D._w$ stands for light absorbance of the reproducing discharge liquid, $V_1$ stands for the amount in ml of the reproducing discharge liquid and $V_2$ stands for the amount of processed sugar liquor.

TABLE 7

| Refining Process | Bx | pH | Electrical Conductivity (Bx 22.8) μs/cm | Ashes % on solid | Sugar | Color Value (sell length, 1 cm) Bx | O.D.720 | T720 (%) | A.I. Decoloration Rate | Amount of Desorbed Colorant/ Amount of Adsorbed Colorant × 100% |
|---|---|---|---|---|---|---|---|---|---|---|
| Dissolution of Washed Sugar | 60.5 | 6.1 | 196 | 0.10 | 99.0 | 50.0 | 0.134 | 73.5 | 2043 (0) | |
| Carbonation | 60.6 | 7.0 | 183 | 0.08 | 99.4 | 50.0 | 0.012 | 97.3 | 756 (63) | |
| Resin | 60.5 | 7.0 | 2.5 | 0.001 | 99.8 | 50.0 | 0.000 | 100.0 | 6 | 90 |

TABLE 7-continued

| Refining Process | Bx | pH | Electrical Conductivity (Bx 22.8) μs/cm | Ashes % on solid | Sugar | Color Value (sell length, 1 cm) Bx | O.D.$_{720}$ | $T_{720}$ (%) | A.I. Decoloration Rate | Amount of Desorbed Colorant/ Amount of Adsorbed Colorant × 100% |
|---|---|---|---|---|---|---|---|---|---|---|
| Processing | | | | | | | | | | |

COMPARATIVE EXAMPLE 1

The washed sugar similar to that of the Preliminary Experiment 8 was processed in accordance with the following refining process to produce the refined sugar liquor.

Sugar Washing→Carbonation (A)→Resin Processing (C)

The following processing conditions for resin processing (C) were adopted.

(C) Resin Processing

The sugar liquor to be processed was passed through a mixed bed of an OH-type strongly basic anion exchange resin and a Na type strongly acidic cation exchange resin and then through an OH type strongly basic anion exchange resin and a H type weakly acidic cation exchange resin for desalting and decoloration.

Table 8 shows the quality of the refined sugar liquor from the respective refining processes.

TABLE 8

| Refining Process | Bx | pH | Electrical Conductivity (Bx 22.8) μs/cm | Ashes % on solid | Sugar | Color Value (sell length, 1 cm) Bx | O.D.$_{720}$ | $T_{720}$ (%) | A.I. Decoloration Rate | Amount of Desorbed Colorant/ Amount of Adsorbed Colorant × 100% |
|---|---|---|---|---|---|---|---|---|---|---|
| Dissolution of Washed Sugar | 60.5 | 6.1 | 196 | 0.10 | 99.0 | 50.0 | 0.134 | 73.5 | 2043 (0) | |
| Carbonation | 60.6 | 7.0 | 183 | 0.08 | 99.4 | 50.0 | 0.012 | 97.3 | 756 (63) | |
| Resin Processing | 60.5 | 6.9 | 17 | 0.001 | 99.7 | 50.0 | 0.000 | 100.0 | 30 | 53 |

COMPARATIVE EXAMPLE 2

Washed sugar similar to that of the Preliminary Experiment 8 was processed in accordance with the following refining process to obtain the refined sugar liquor.

Sugar Washing→Carbonation (A)→Active Carbon Processing (D)→Resin Processing (C).

The following processing conditions were adopted for active carbon processing (D).

(D) Active Carbon Processing

A predetermined amount of dried carboraffin (washed sugar; 0.20% and 0.40%, based on solid contents, with raw sugar from Okinawa and with raw sugar from Thailand, respectively) was added to the sugar liquor to be processed. As the resulting mixture was maintained at 70° C., it was stirred for 60 minutes to effect the contact reaction. After the reaction, filtration through diatomaceous earth was performed to produce the supernant liquid.

Table 9 shows the quality of the refined sugar liquor from each refining process.

TABLE 9

| Refining Process | Bx | pH | Electrical Conductivity (Bx 22.8) μs/cm | Ashes % on solid | Sugar | Color Value (sell length, 1 cm) Bx | O.D.$_{720}$ | $T_{720}$ (%) | A.I. Decoloration Rate | Amount of Desorbed Colorant/ Amount of Adsorbed Colorant × 100% |
|---|---|---|---|---|---|---|---|---|---|---|
| Dissolution of Washed Sugar | 60.5 | 6.1 | 196 | 0.10 | 99.0 | 50.0 | 0.134 | 73.5 | 2043 (0) | |
| Carbonation | 60.6 | 7.0 | 183 | 0.08 | 99.4 | 50.0 | 0.012 | 97.3 | 756 (63) | |
| Active Carbon Processing | 60.6 | 7.1 | 175 | 0.08 | 99.5 | 50.5 | 0.009 | 98.0 | 121 | |
| Resin Processing | 60.5 | 6.9 | 18 | 0.004 | 99.7 | 50.0 | 0.000 | 100.0 | 10 | 60 |

It is seen from these Tables that the refined sugar liquor obtained in the Preliminary Experiment 8 according to the present invention compares favorably with that of the Comparative Experiment 1 as to the color value and ashes (electrical conductivity). In the Preliminary Experiment, the number of times of liquid passage was twice that of the Comparative example 1, while the amount of produced sweet water was reduced to one half that of the Comparative Example 1.

The quality of the refined sugar liquor was similar to that of the comparative Example 2, this meaning that, conversely, the active carbon processing step in the conventional refining system may be eliminated in the present process.

Based on the results of the above described preliminary experiments, various refining processes were conducted with cristobalite and the ion exchange resins.

EXAMPLE 1

Raw sugar from Thailand was processed in accordance with the following refining process to produce refined sugar liquor.

Raw Sugar from Thailand→processing with Cristobalite (E)→Carbonation (A)→Active Carbon Processing (D)→Resin Processing (B).

The following processing conditions were adopted in the respective refining processes.

(E) Processing with Cristobalite

The solution of raw sugar adjusted to Bx 60 was admixed with lime milk (Bx 20) to adjust the pH value to 9.5 to 10.0. The resulting mixture was heated to 70° C. and reacted for 60 minutes. The resulting reaction product was passed as a descending stream through a device consisting of three tandem connected towers heated to 60° C., wherein each tower is formed by a column fitted with an outer tube.

The respective towers were charged with cristobalite of variable particle sizes produced by Nittetsu Kogyo Co. Ltd. under the trade name of (CRYSVARL WGL), such that the coarse, medium and fine size particles are packed in the first to third towers, respectively.

The particle size for the first tower was 0.5 to 10.0 mm (coarse size), that for the second tower was 0.1 to 1.0 mm (medium size) and that for the third tower was 0.01 to 0.5 mm (fine size).

Table 10 shows the quality of the refined sugar liquor from each of the refining processes.

TABLE 10

| Refining Process | Bx | pH | Electrical Conductivity (Bx 22.8) μs/cm | Ashes % on solid | Sugar | Color Value (sell length, 1 cm) Bx | O.D.$_{720}$ | $T_{720}$ (%) | A.I. Decoloration Rate | Amount of Desorbed Colorant/ Amount of Adsorbed Colorant × 100% |
|---|---|---|---|---|---|---|---|---|---|---|
| Solution of Thailand Raw Sugar | 60.5 | 5.3 | 592 | 0.37 | 98.3 | 19.8 | 0.145 | 71.6 | 9221 (0) | |
| Processing with Cristobalite | 60.4 | 5.3 | 621 | 0.42 | 98.5 | 22.6 | 0.066 | 85.9 | 7391 (20) | |
| Carbonation | 60.2 | 7.1 | 507 | 0.31 | 98.6 | 29.8 | 0.021 | 95.3 | 3084 (67) | |
| Active Carbon Processing | 60.7 | 7.5 | 491 | 0.29 | 98.7 | 50.0 | 0.010 | 97.7 | 54 | |
| Resin Processing | | | | | | | | | | 81 |
| Liquid from Pre-Stage | 60.5 | 7.5 | 385 | 0.21 | | 50.0 | 0.001 | 99.8 | 54 | |
| Liquid from Post-Stage | 60.6 | 7.6 | 3.0 | 0.001 | 99.1 | 50.0 | 0.000 | 100.0 | 12 | |

Figure 4:
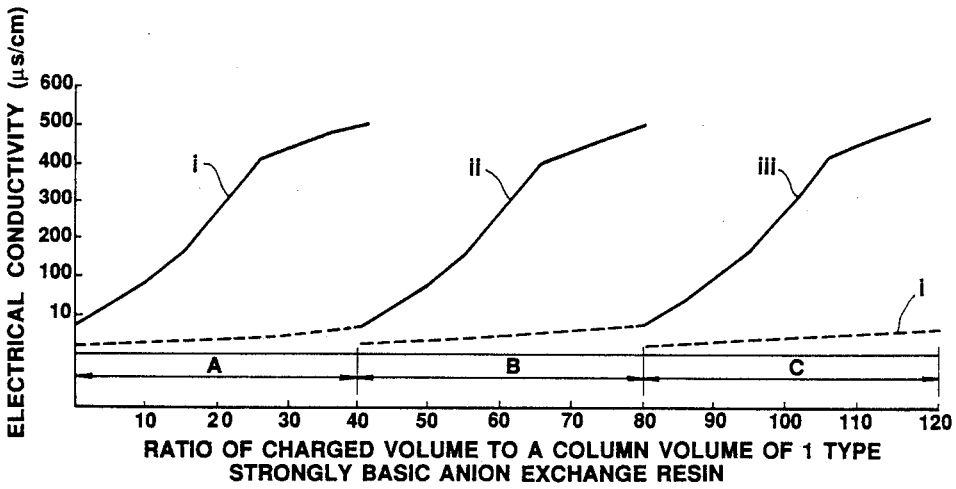
FIG. 4 is a diagram showing characteristic changes in electrical conductivity of an effluent liquid from each resin tower in the ion exchange resin processing system.
Figure 5:
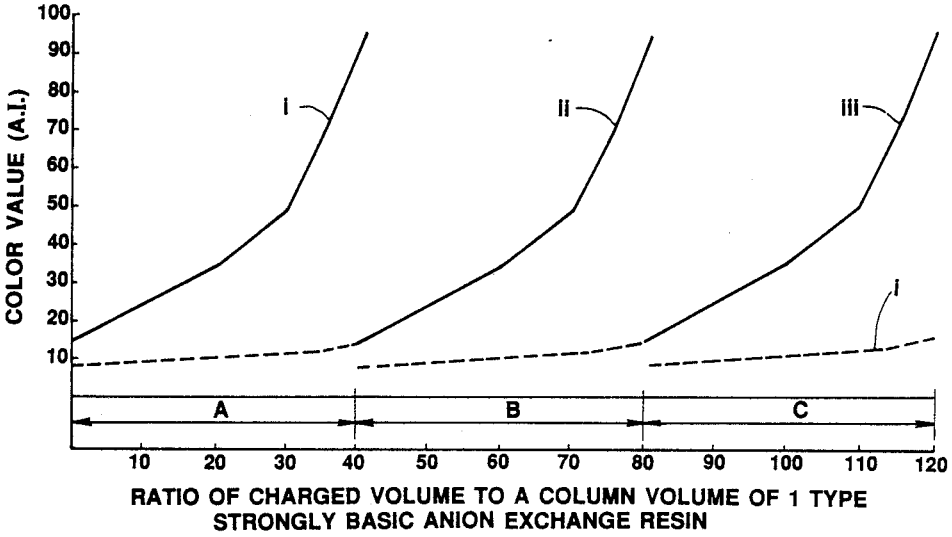
FIG. 5 is a diagram showing characteristic changes in the color value of an effluent liquid from each resin tower in the ion exchange resin processing system.

In the resin processing (B), the electrical conductivity and the color value of the liquid effluent from each resin tower investigated. The results are shown in FIGS. 4 and 5.

In these figures, the time intervals A, B and C correspond to the process steps shown in FIGS. 2A, 2B and 2C, respectively.

During the time interval A, the first resin tower 11 is used as the pre-stage, with the electrical conductivity and the color value (shown by a line i in the drawing) of the liquid effluent being increased acutely. During this time, the second resin tower 12 is used as the post-stage, with the electrical conductivity and the color value (shown by a line ii in the drawing) of the liquid effluent from the resin tower 12 being scarcely changed. This means that the second resin tower 12 can be used for desalting and decoloration sufficiently even after termination of the time interval A.

During the time interval B, some increase is noticed in the electrical conductivity and color value of the liquid effluent from the second resin tower 12. The resin tower 12 is shifted to the pre-stage, whilst the first resin tower 11 is shifted to the regenerating stage and the third resin tower 13 is shifted to the post-stage. At this time, the electrical conductivity and the color value of the liquid effluent from the second resin tower at the pre-stage is increased acutely. The electrical conductivity and the color value (shown by line iii in the drawing) of the liquid effluent from the third resin tower 13, are scarcely changed.

During the time interval C, the third resin tower 13 is shifted to the pre-stage whilst the first resin tower 11 is shifted to the post-stage and the second resin tower 12 is shifted to the regenerating stage. The electrical conductivity and the color value of the liquid effluent from the third resin tower shifted to the pre-stage are increased acutely. At this time, the first resin tower 11 used for the post-stage has been regenerated and hence the electrical conductivity and the color value of the liquid effluent therefrom exhibit the initial low values.

COMPARATIVE EXAMPLE 1

The same raw sugar from Thailand as that used in Example 1 was processed in accordance with the following conventional refining process.

Raw Sugar from Thailand→Carbonation (A)→Active Carbon Processing (D)→Resin Processing for Desalting (I)

(I) Resin Processing for Desalting

The sugar solution to be processed was passed through a mixed bed of the OH type strongly basic anion exchange resin and the Na type strongly acidic cation exchange resin and then through the OH type strongly basic anion exchange resin and the H type weakly acidic cation exchange resin for desalting and decoloration.

COMPARATIVE EXAMPLE 2

The same raw sugar from Thailand as that used in Example 1 was processed in accordance with the following conventional refining process.

Raw Sugar from Thailand→Carbonation (A)→Active Carbon Processing (D)→Resin Processing for Decoloration (II).

(II) Resin Processing for Decoloration

The sugar liquor to be processed was passed through a Cl type strongly basic anion exchange resin for decoloration.

Table 11 shown the quality of the sugar liquor in each refining process of the Comparative Examples 1 and 2.

TABLE 11

| Refining Process | Bx | pH | Electrical Conductivity (Bx 22.8) μs/cm | Ashes % on solid | Sugar | Color Value (sell length, 1 cm) Bx | O.D.$_{720}$ | $T_{720}$ (%) | A.I. Decoloration Rate | Amount of Desorbed Colorant/ Amount of Adsorbed Colorant × 100% |
|---|---|---|---|---|---|---|---|---|---|---|
| Solution of Thailand Raw Sugar | 60.5 | 5.3 | 592 | 0.37 | 98.3 | 19.8 | 0.145 | 71.6 | 9221 (0) | |
| Carbonation | 60.2 | 6.9 | 528 | 0.32 | 98.4 | 30.1 | 0.065 | 86.1 | 4426 (52) | |
| Active Carbon Processing | 60.7 | 7.2 | 503 | 0.31 | 98.5 | 30.0 | 0.033 | 92.6 | 2212 (76) | |
| Resin Processing desalting (I) | 60.5 | 6.9 | 14 | 0.01 | 98.8 | 50.0 | 0.010 | 97.7 | 58 | 51 |
| decoloration (II) | 60.6 | 7.0 | 496 | 0.30 | 98.5 | 50.1 | 0.030 | 93.3 | 279 | 33 |

EXAMPLE 2

Raw sugar from Okinawa—ken, Japan, was processed in accordance with the following refining process to produce refined sugar liquor.

Raw Sugar from Okinawa→Processing with Cristobalite (E)→Active Carbon Processing (D)→Resin Processing (B).

Table 12 shows the quality of the sugar liquor from each refining process. The resin processing is carried out as in Example 1, but the carbonation process is omitted.

TABLE 12

| Refining Process | Bx | pH | Electrical Conductivity (Bx 22.8) μs/cm | Ashes % on solid | Sugar | Color Value (sell length, 1 cm) Bx | O.D.$_{720}$ | $T_{720}$ (%) | A.I. Decoloration Rate | Amount of Desorbed Colorant/ Amount of Adsorbed Colorant × 100% |
|---|---|---|---|---|---|---|---|---|---|---|
| Dissolution of Okinawa raw sugar | 61.2 | 6.0 | 996 | 0.53 | 30.0 | 0.109 | 77.8 | 3239 | | |
| Processing with Cristobalite | 61.2 | 6.0 | 1009 | 0.55 | 30.2 | 0.018 | 95.9 | 1685 (48) | | |
| Active Carbon Processing | 61.7 | 6.6 | 743 | 0.54 | 30.1 | 0.007 | 98.4 | 1022 (69) | | |
| Resin Processing | | | | | | | | | | 80 |
| Liquid from Pre-Stage | 62.0 | 6.8 | 394 | 0.22 | 50.0 | 0.006 | 98.6 | 56 | | |
| Liquid from Post-Stage | 62.0 | 6.7 | 3.1 | 0.001 | 50.0 | 0.001 | 99.8 | 10 | | |

EXAMPLE 3

Raw sugar from Natar was processed in accordance with the following refining process to produce refined sugar liquor.

Raw Sugar from Natar→Processing with Cristobalite (E)→Carbonation (A)→Resin Processing (B).

Table 13 shows the quality of the sugar liquor from each refining process. The refining processes are similar to those of Example 1, but the active carbon processing step is not carried out in the present Exmaple.

TABLE 13

| Refining Process | Bx | pH | Electrical Conductivity (Bx 22.8) μs/cm | Ashes % on solid | Sugar | Color Value (sell length, 1 cm) Bx | O.D.$_{720}$ | $T_{720}$ (%) | A.I. Decoloration Rate | Amount of Desorbed Colorant/ Amount of Adsorbed Colorant × 100% |
|---|---|---|---|---|---|---|---|---|---|---|
| Dissolution of Natar Raw Sugar | 59.6 | 6.1 | 328 | 0.15 | 98.1 | 30.0 | 0.154 | 70.1 | 3381 (0) | |
| Processing with Cristobalite | 60.0 | 6.0 | 372 | 0.18 | 98.3 | 49.7 | 0.044 | 90.3 | 2135 (37) | |
| Carbonation Resin Processing | 60.4 | 6.8 | 349 | 0.14 | 98.4 | 50.2 | 0.007 | 98.4 | 994 (71) | 82 |
| Liquid from Pre-Stage | 60.5 | 6.9 | 165 | 0.09 | | 50.2 | | | 30 | |
| Liquid from Post-Stage | 60.6 | 7.0 | 3.7 | 0.002 | 98.8 | 50.1 | 0.000 | 100.0 | 7 | |

EXAMPLE 4

The washed sugar from the sugar washing process of sugar refinery was processed in accordance with the following refining process to produce the refined sugar liquor.

Sugar Washing→Processing with Cristobalite (F)→Resin Processing (B)

(F) Processing with Cristobalite 0.1% of powdered magnesium oxide, produced by Hokkaido soda Co. Ltd., based on solid contents, was added to a solution of washed sugar adjusted to about Bx 60 and the resulting mixture was heated to 70° C. and reacted for 60 minutes. Then, using the device similar to that used for cristobalite processing (E) in Example 1, the reaction product was passed through the first tower as the ascending stream and through the second and third towers as the descending stream.

Table 14 shows the quality of the sugar liquor from each refining process. The resin processing was carried out as in Example 1, but the carbonation and active carbon processing were omitted.

TABLE 14

| Refining Process | Bx | pH | Electrical Conductivity (Bx 22.8) μs/cm | Ashes % on solid | Sugar | Color Value (sell length, 1 cm) Bx | O.D.$_{720}$ | $T_{720}$ (%) | A.I. Decoloration Rate | Amount of Desorbed Colorant/ Amount of Adsorbed Colorant × 100% |
|---|---|---|---|---|---|---|---|---|---|---|
| Dissolution of Washed Sugar | 61.7 | 6.1 | 196 | 0.10 | 99.0 | 50.1 | 0.134 | 73.5 | 2043 (0) | |
| Processing with Cristobalite | 61.3 | 6.2 | 192 | 0.10 | 99.4 | 50.0 | 0.015 | 96.6 | 1021 (50) | |
| Resin Processing | | | | | | | | | | 85 |
| Liquid from Pre-Stage | 61.5 | 6.4 | 87 | 0.05 | | 50.1 | 0.004 | 99.1 | 51 | |
| Liquid from Post-Stage | 61.5 | 6.5 | 1.3 | 0.001 | 99.7 | 50.0 | 0.000 | 100.0 | 9 | |

EXAMPLE 5

The washed sugar as that used in Example 4 was processed in accordance with the following refining process to produce the refined sugar liquor.

Sugar Washing→Cristobalite Processing (E)→Resin Processing (I)

Table 15 shows the quality of sugar liquor from each refining process. Processing with cristobalite is carried out as in Example 1 and resin processing is carried out as in Comparative Example 1. The carbonation and processing with active carbon are omitted in the present Example.

TABLE 15

| Refining Process | Bx | pH | Electrical Conductivity (Bx 22.8) μs/cm | Ashes % on solid | Sugar | Color Value (sell length, 1 cm) Bx | O.D.720 | T720 (%) | A.I. Decoloration Rate | Amount of Desorbed Colorant/ Amount of Adsorbed Colorant × 100% |
|---|---|---|---|---|---|---|---|---|---|---|
| Dissolution of Washed Sugar | 60.5 | 6.1 | 196 | 0.10 | 99.0 | 50.0 | 0.134 | 73.5 | 2043 (0) | |
| Processing with Cristobalite | 60.4 | 6.2 | 197 | 0.10 | 99.4 | 50.0 | 0.016 | 96.4 | 1019 (50) | |
| Resin Processing | 60.5 | 6.4 | 14 | 0.01 | 99.6 | 50.0 | 0.003 | 99.3 | 35 | 50 |

EXAMPLE 6

The same washed sugar as that used in Example 4 was processed in accordance with the following refining process to produce refined sugar liquor.

Sugar Washing Cristobalite Processing
(E)→Powdered Resin Processing (G)

(G) Powdered Resin Processing

The powdered anion exchange resin having the particle size of not more than 50 μm (mean particle size: 18.5 μm), produced by air stream pulverization from particulate strongly basic anion exchange resin (Amberlite IRA-401 produced by Rohm & Haas Inc.), was added at a rate of 0.5 w/v as dry matter to the sugar liquor to be processed, and the resulting mass was mixed and stirred at 70° C. for 30 minutes. After contact reaction, the resulting reaction product was filtered through a membrane filter having the pore size of 3 μm to produce a clear liquor.

Table 16 shows the quality of sugar liquor from each refining process. Processing with cristobalite is carried out as in Example 1. The carbonation and the processing with active carbon are omitted in the present Example.

TABLE 16

| Refining Process | Bx | pH | Electrical Conductivity (Bx 22.8) μs/cm | Ashes % on solid | Sugar | Color Value (sell length, 1 cm) Bx | O.D.720 | T720 (%) | A.I. Decoloration Rate | Amount of Desorbed Colorant/ Amount of Adsorbed Colorant × 100% |
|---|---|---|---|---|---|---|---|---|---|---|
| Dissolution of Washed Sugar | 60.5 | 6.1 | 196 | 0.10 | 99.0 | 50.0 | 0.134 | 73.5 | 2043 (0) | |
| Processing with Cristobalite | 60.4 | 6.2 | 197 | 0.10 | 99.4 | 50.0 | 0.016 | 96.4 | 1019 (50) | |
| Resin Processing | 60.5 | 6.4 | 212 | 0.10 | 99.5 | 50.0 | 0.000 | 100.0 | 93 | 90 |

EXAMPLE 7

The fine liquor obtained in Example 2 was passed to a crystallization process and the No. 3 molasses remaining thereat (Bx 60) was separated continuously by ion chromatography, using a pseudo moving bed type chromatographic separating device (Mitsubishi Diaion UBK 530, Na type). Water was used as the eluting liquid.

The results are shown in Table 17. The produced sucrose fraction is used again in the sugar baking process. The reducing sugar fraction is processed into liquid sugar products or used as the starting material for high added-value products.

TABLE 17

| | Eluting Liquid (Water) | Feed Liquor (Molasses) | Liquid Fraction: Sucrose Fraction | Liquid Fraction: Reducing Sugar Fraction |
|---|---|---|---|---|
| Bx | | 60.0 | 30.0 | 12.5 |
| Sucrose Portion | | 86.0 | 96.4 | 43.7 |
| Reducing Sugar Portion | | 11.8 | 1.0 | 55.8 |
| Non-Sugar Portion (% on solid) | | 2.2 | 2.6 | 0.5 |
| Recovery Rate (%) | | | not less than 90 | not less than 93 |
| Flow Rate (l/h) | 5.5 | 2.8 | 5.1 | 3.2 |

What is claimed is:

1. A method for refining a sugar liquor wherein the sugar liquor is contacted with cristobalite and then with an ion exchange resin comprising a strong basic anion exchange resin.

2. A method for refining a sugar liquor wherein the sugar liquor is contacted with cristobalite and then passed through a strongly basic anion exchange resin and a weakly acidic cation exchange resin arrayed downstream thereof, for refining of the sugar liquor, and wherein;

during regeneration of the anion and cation exchange resins, a regenerating liquid effluent from said weakly acidic anion exchange resin is passed through said strongly basic anion exchange resin.

3. A method according to claim 2 wherein the anion and cation exchange resins are provided in three series of adsorption towers as basic units, these three series of adsorption towers being a pre-stage adsorption tower, a post-stage adsorption tower and an adsorption tower for regeneration, the sugar liquor being passed continuously from said pre-stage adsorption tower to said post-stage adsorption tower, and wherein;

on detection of the lowering of the refining capacity of said post-stage adsoption tower, said pre-stage adsorption tower is shifted to said adsorption tower for regeneration, at the same time that said post-stage adsorption tower is shifted to said pre-stage adsorption tower and said adsorption tower for regeneration is shifted to said post-stage adsorption tower.

4. A method according to claim 3 wherein an anion exchange resin and/or cation exchange resin of lower basicity are arrayed ahead of said strongly basic anion exchange resin.

5. A method according to claim 4 wherein the weakly acidic cation exchange resin is regenerated by mineral acid, the resulting regenerating mineral acid liquid effluent from said weakly acidic cation exchange resin is supplied sequentially at not lower than 40° C. through the strongly basic anion exchange resin and the anion exchange resin and/or the cation exchange resin of lower basicity for pre-regenerating these ion exchange resins, said regenerating mineral acid liquid effluent is displaced and washed out, and an alkaline agent is sequentially passed through the strongly basic anion exchange resin and the anion exchange resin and/or the cation exchange resin of lower basicity for finally regenerating these ion exchange resins.

6. The method according to claim 1, 2, 3, 4 or 5 wherein the sugar liquor is non-washed sugar liquor.

7. The method according to claim 1, 2, 3, 4 or 5 wherein suspended substances are produced in the sugar liquor by addition of a flocculent prior to the treatment with cristobalite.

8. A method according to claim 1, 2, 3, 4 or 5 wherein cristobalite is provided in the form of a packing layer consisting of course, medium and fine size particles and wherein the sugar liquor is passed sequentially through layers of the coarse size particles, medium size particles and fine size particles.

9. A method according to claim 6 wherein cristobalite is in the form of a packing layer consisting of course, medium and fine size particles and wherein the sugar liquor is passed sequentially through layers of the coarse size particles, medium size particles and fine size particles.

10. A method according to claim 7 wherein cristobalite is in the form of a packing layer consisting of course, medium and fine size particles and wherein the sugar liquor is passed sequentially through layers of the coarse size particles, medium size particles and fine size particles.

11. A method for refining sugar liquor wherein a non-washed sugar liquor is contacted with cristobalite and an ion exchange resin comprising a strong basic anion exchange resin, eluate therefrom is subjected to crystallization to recover crystalline sugar, and residual molasses from the crystallization is fractionated by ion exchange chromatography to obtain a sucrose fraction.

* * * * *